US009682758B2

(12) United States Patent
Kuriyagawa et al.

(10) Patent No.: US 9,682,758 B2
(45) Date of Patent: Jun. 20, 2017

(54) OUTBOARD MOTOR CONTROL APPARATUS

(71) Applicant: HONDA MOTOR CO., LTD., Minato-Ku, Tokyo (JP)

(72) Inventors: Koji Kuriyagawa, Wako (JP); Hajime Yoshimura, Wako (JP); Masahide Shinokawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 64 days.

(21) Appl. No.: 14/224,895

(22) Filed: Mar. 25, 2014

(65) Prior Publication Data

US 2014/0295717 A1 Oct. 2, 2014

(30) Foreign Application Priority Data

Mar. 29, 2013 (JP) ..... 2013-072843
Mar. 29, 2013 (JP) ..... 2013-073445

(51) Int. Cl.
*B63H 21/22* (2006.01)
*B63H 23/00* (2006.01)
*B63H 20/10* (2006.01)

(52) U.S. Cl.
CPC ..... *B63H 20/10* (2013.01)

(58) Field of Classification Search
CPC ..... B63H 20/00; B63H 20/08; B63H 20/10; B63H 21/21; B63H 21/26; B63H 2020/00; B63H 2020/08; B63H 2020/10; B63H 2021/21; B63H 2021/216
USPC ..... 440/1–3, 61 T, 61 G, 84, 87
See application file for complete search history.

(56) References Cited

U.S. PATENT DOCUMENTS 6,997,763 B2 2/2006 Kaji
8,382,536 B2 * 2/2013 Kuriyagawa et al. ..... 440/1
8,764,500 B2 * 7/2014 Kuriyagawa et al. ..... 440/86

* cited by examiner

*Primary Examiner* — Daniel V Venne
(74) *Attorney, Agent, or Firm* — Carrier Blackman & Associates, P.C.; Joseph P. Carrier; Jeffrey T. Gedeon

(57) ABSTRACT

In a method for controlling an outboard motor adapted to be mounted on a hull of a boat and equipped with an internal combustion engine to power a propeller and a trim angle regulating mechanism adapted to regulate a trim angle relative to the hull, comprising the steps of: calculating a throttle opening change amount of the engine; determining whether the boat is in an accelerating state based on the calculated throttle opening change amount; and controlling operation of the trim angle regulating mechanism to increase the trim angle based on an operating parameter that indicates a state of the engine and the propeller when it is determined that the boat is in the accelerating state.

12 Claims, 8 Drawing Sheets

OUTBOARD MOTOR CONTROL APPARATUS

BACKGROUND

Technical Field

An embodiment of this invention relates to an apparatus for controlling an outboard motor, more specifically to an apparatus for controlling an outboard motor equipped with a trim angle regulating mechanism adapted to regulate a trim angle relative to a hull.

Background Art

There has been proposed an apparatus for controlling an outboard motor installed on a boat equipped with a trim angle regulating mechanism to regulate a trim angle relative to a hull and to accelerate efficiently by controlling the trim angle based on a navigation speed, an engine speed and the like when the boat accelerates to the maximum navigation speed, for example, by U.S. Pat. No. 6,997,763 filed and patented claiming the priority of Japanese Patent No. 3957137.

SUMMARY

However, cavitation can be caused around a propeller to degrade the accelerating performance of the boat by conducting trimming up during acceleration of the boat.

Therefore, an embodiment of this invention is directed to overcoming the foregoing problems by providing an apparatus for controlling an outboard motor, which suppresses occurrence of cavitation whenever possible not to degrade the accelerating performance of the boat even conducting trimming up during acceleration of the boat.

In order to achieve the object, the embodiment of this invention provides a method for controlling an outboard motor adapted to be mounted on a hull of a boat and equipped with an internal combustion engine to power a propeller and a trim angle regulating mechanism adapted to regulate a trim angle relative to the hull, comprising the steps of: calculating a throttle opening change amount of the engine; determining whether the boat is in an accelerating state based on the calculated throttle opening change amount; and controlling operation of the trim angle regulating mechanism to increase the trim angle based on an operating parameter that indicates a state of the engine and the propeller when the step of accelerating state determining determines that the boat is in the accelerating state.

BRIEF DESCRIPTION OF THE DRAWINGS

The above and other objects and advantages of an embodiment of this invention will be more apparent from the following description and drawings in which.

DESCRIPTION OF EMBODIMENT

An apparatus for controlling an outboard motor, according to an embodiment of this invention will be explained with reference to the attached drawings.

Figure 1:
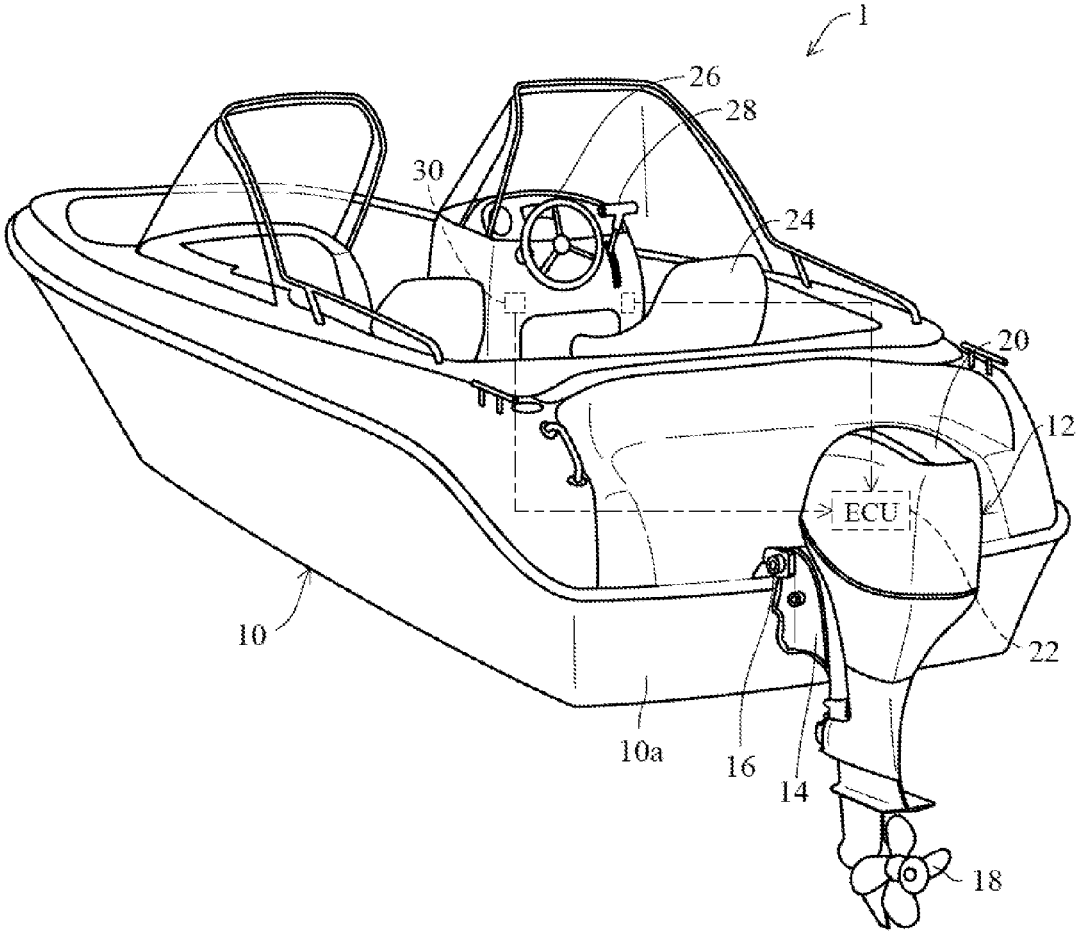
FIG. 1 is an overall schematic view of an outboard motor installed on a boat to which an apparatus for controlling an outboard motor, according to the embodiment of this invention is applied.

FIG. 1 is an overall schematic view of an outboard motor installed on a boat to which the apparatus according to the embodiment is applied.

In FIG. 1, symbol 1 indicates a boat mounted with an outboard motor 12 on its hull 10. The outboard motor 12 is clamped to a stern or transom 10A of the hull 10 with stern brackets 14 and a tilting shaft 16.

The outboard motor 12 has an internal combustion engine (not shown, hereinafter referred to as "engine") 52, a propeller 18 driven by the engine 52, and an engine cover 20 covering the engine 52. The engine cover 20 accommodates an Electronic Control Unit (hereinafter referred to as "ECU") 22 in its interior space (engine room) in addition to the engine 52. The ECU 22 has a microcomputer comprising a CPU, ROM, RAM and other devices, and functions as the apparatus for controlling operation of the outboard motor 12.

A steering wheel 26 is installed near a cockpit 24 of the hull 10 to be rotatably manipulated by the operator (not shown). A shift/throttle lever (shift lever) 28 is also installed near the cockpit 24 to be manipulated by the operator. The shift/throttle lever 28 is adapted to be moved or swung in front-back direction from its initial position and to be used by the operator to input shift instructions (shift change instructions to forward, reverse or neutral) and engine speed instructions (acceleration/deceleration instruction to the engine 52).

A GPS receiver 30 is provided at an appropriate location of the hull 10 to receive Global Positioning System signals and outputs signals indicative of the positional information of the boat 1 obtained from the GPS signals to the ECU 22.

Figure 2:
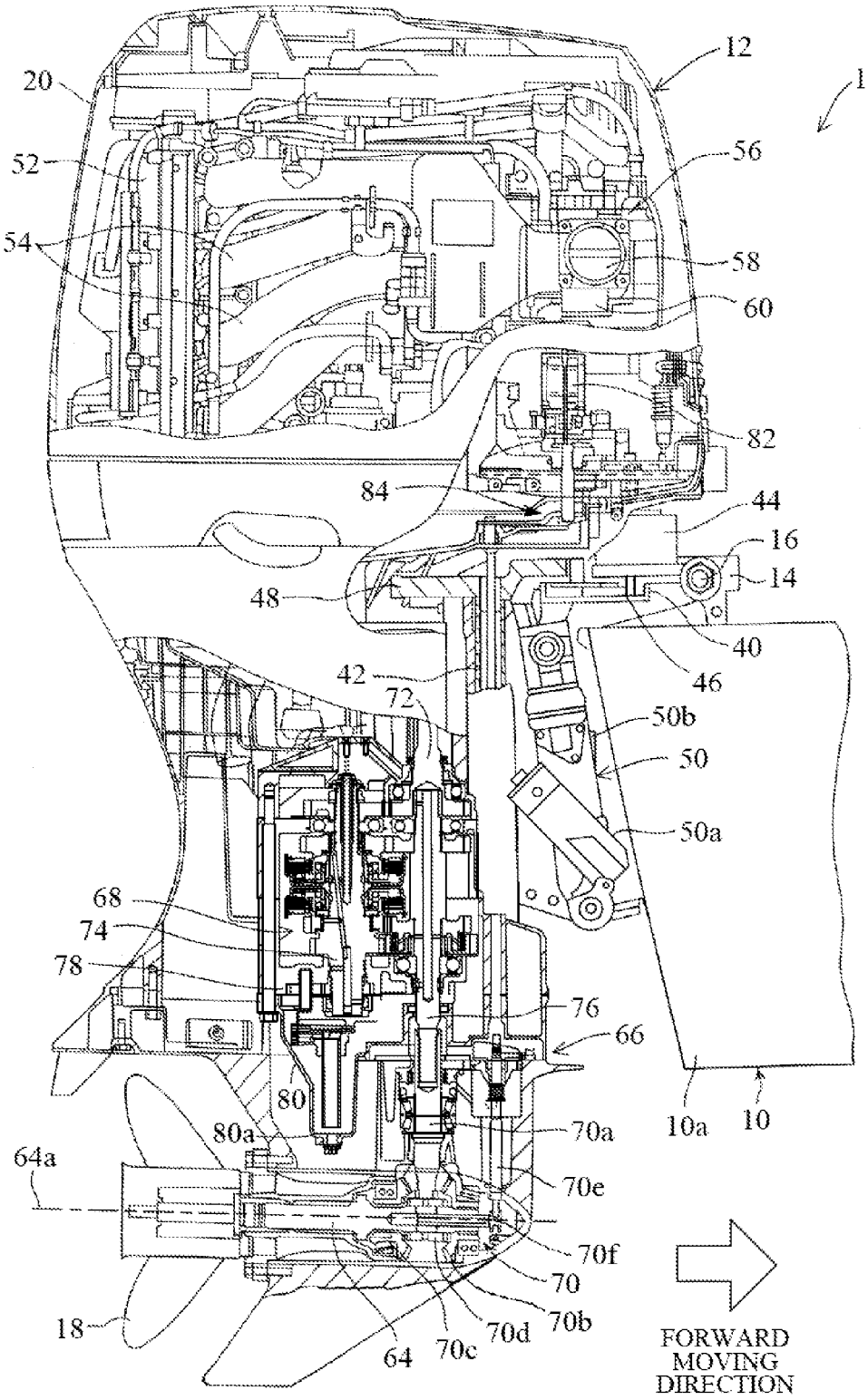
FIG. 2 is an enlarged sectional side view showing the outboard motor shown in FIG. 1.
Figure 3:
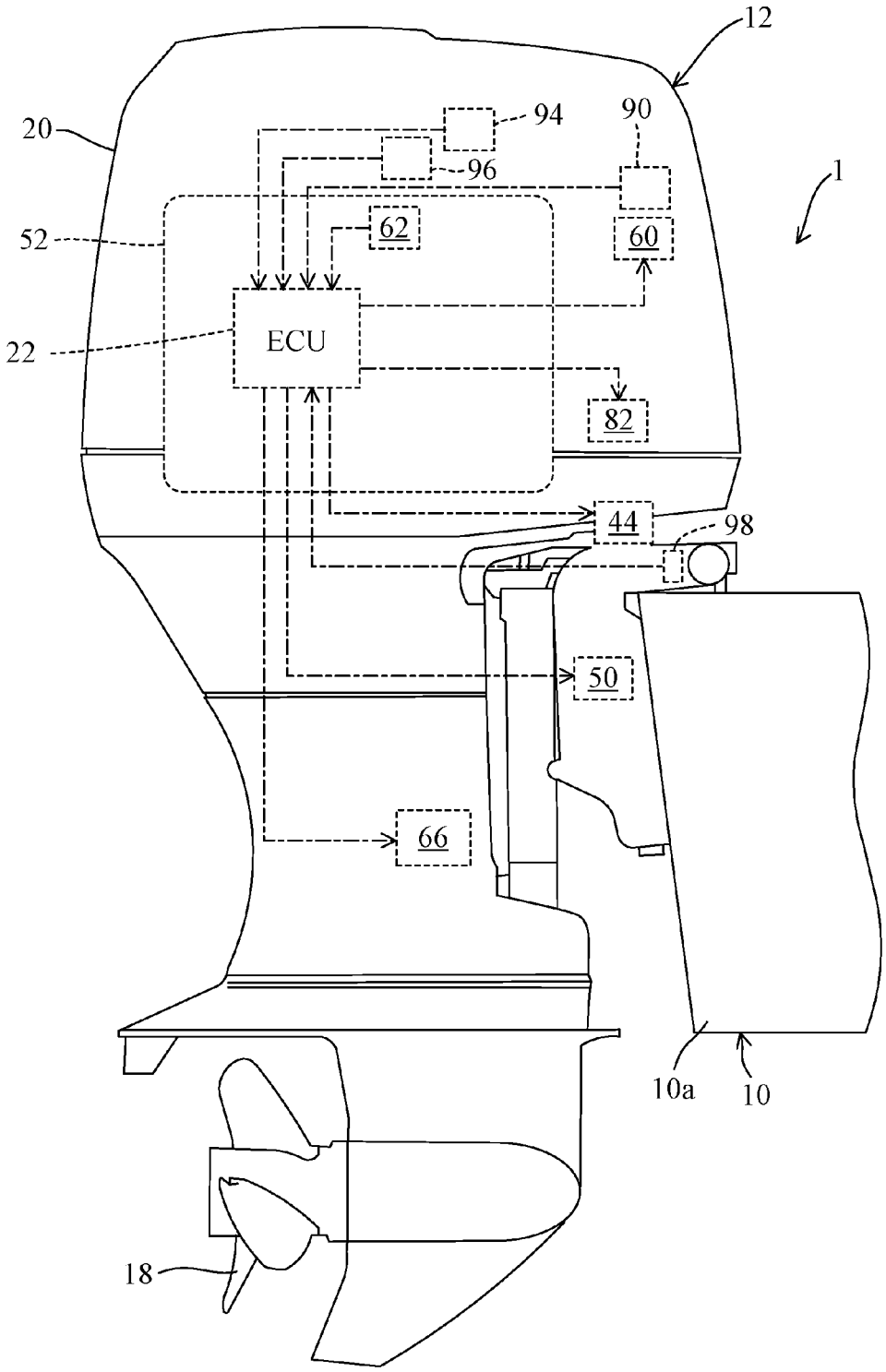
FIG. 3 is an enlarged side view of the outboard motor shown in FIG. 1.

FIG. 2 is an enlarged sectional side view showing the outboard motor 12 and FIG. 3 is an enlarged side view of the outboard motor 12.

As shown in FIG. 2, the outboard motor 12 is provided with a shaft unit 42 vertical-axis-rotatably accommodated inside a swivel case 40, and an electric turning motor 44 for driving the shaft unit 42 through a speed reduction gear mechanism 46 and a mount frame 48. With this, the outboard motor 12 is rotated to the left or right about the shaft unit 42 (vertical axis) by rotating the shaft unit 42 with the electric turning motor 44.

A power tilt/trim unit (trim angle regulating mechanism) 50 is installed near the swivel case 40. The power tilt/trim unit 50 is adapted to regulate a tilt/trim angle of the outboard motor 12 relative to the hull 10 by tilting up/down or trimming up/down the outboard motor 12. The power tilt/trim unit 50 is integrated with a hydraulic cylinder 50*a*/50*b* for regulating the tilt/trim angle. The swivel case 40 is adapted to be rotated about tilting shaft 16 by extending or contracting the hydraulic cylinder 50*a*/50*b* to tilt/trim up or down the outboard motor 12. The hydraulic cylinders 50*a* and 50*b* are connected to a hydraulic circuit (not shown) of the outboard motor 12 and are extended or contracted when supplied with hydraulic oil (pressure).

The outboard motor 12 is provided with the engine 52 at its upper portion. The engine 52 comprises a spark-ignition water-cooled gasoline engine with a displacement of 2,200 cc. The engine 52 is located above the water surface and is covered by the engine cover 20.

A throttle body 56 is connected to an air intake pipe 54 of the engine 52. The throttle body 56 has a throttle valve 58 installed therein and is integrated with an electric throttle motor 60 for opening and closing the throttle valve 58.

An output axis of the electric throttle motor 60 is connected to the throttle valve 58 through a speed reduction gear mechanism (not shown). With this, the throttle valve 58 is opened or closed by operating the throttle motor 60 and thereby regulating the flow of intake air to the engine 52 to control an engine speed NE.

The engine 52 has a variable valve timing mechanism 62 (shown in FIG. 3). The variable valve timing mechanism 62 is adapted to change the valve (opening or closing) timing/lift of an intake/exhaust valve based on the operating condition of the engine 52. Though not explained in detail, the variable valve timing mechanism 62 is activated by drive signals from the ECU 22 to change the valve timing/lift to relatively large values in high-load operating condition with high revolution and high load, while to change the valve timing/lift to relatively small values in low-load operating condition with low revolution and low load. With this, it becomes possible to optimize the valve timing/lift in both low-revolution condition and high-revolution condition to take advantages of both the high engine torque in low-revolution condition and the high engine power in high-revolution condition.

The outboard motor 12 is provided with a propeller shaft 64 horizontal-axis-rotatably supported and connected to the propeller 18 at one end to transmit the power from the engine 52 to the propeller 18, and a transmission 66 installed between the engine 52 and the propeller shaft 64 and equipped with a plurality of gears including first and second speed gears.

An axis 64*a* of the propeller shaft 64 is approximately parallel to the forward moving direction of the boat 1 in the initial state of the power tilt/trim unit 50 (when the trim angle is equal to an initial angle). The transmission 66 comprises a transmission mechanism 68 adapted to shift among a plurality of gears and a shift mechanism 70 adapted to select a shift position from among a forward, reverse and neutral positions.

The transmission mechanism 68 is a parallel-axis type conventional stepped gear ratio transmission mechanism comprising an input shaft 72 connected to a crankshaft (not shown) of the engine 52, a countershaft 74 connected to the input shaft 72 through a gear and an output shaft 76 connected to the countershaft 74 through a plurality of gears, all disposed parallel to each other.

The countershaft 74 is connected to a hydraulic oil pump 78 adapted to supply hydraulic oil (lubricant) to hydraulic clutch for shifting and lubricant-requiring portions. A case 80 accommodates the input shaft 72, countershaft 74, output shaft 76 and oil pump 78 inside it and the lower portion of the case 80 functions as an oil pan 80*a*.

The shift mechanism 70 comprises a drive shaft 70*a* vertical-axis-rotatably connected to the output shaft 76 of the transmission mechanism 68, forward and reverse bevel gears 70*b* and 70*c* rotatably connected to the drive shaft 70*a*, and a clutch 70*d* adapted to mesh the propeller shaft 64 to the forward or reverse bevel gear 70*b* or 70*c*.

The engine cover 20 accommodates an electric shifting motor 82 for driving the shift mechanism 70 in its interior space. An output axis of the electric shifting motor 82 is adapted to be connected to the upper end of a shift rod 70*e* of the shift mechanism 70 through a speed reduction gear mechanism 84. Therefore, the shift rod 70*e* and a shift slider 70*f* are displaced appropriately by driving the electric shifting motor 82 thereby operating the clutch 70*d* to select the shift position from among the forward, reverse and neutral positions.

When the shift position is the forward or reverse position, the rotation of the output shaft 76 of the transmission mechanism 68 is transmitted to the propeller shaft 64 through the shift mechanism 70 thereby rotating the propeller 18 to produce propelling power (driving force) to move the boat 1 forward or backward. The outboard motor 12 has a power source such as a battery (not shown) for powering the aforesaid electric motors 44, 60, 82 and the like installed to the engine 52.

As shown in FIG. 3, a throttle opening sensor 90 is installed near the throttle valve 58 to produce an output or signal indicative of a throttle opening TH of the throttle valve 58; a crank angle sensor (engine speed detector) 94 is installed near the crankshaft of the engine 52 to produce a pulse signal at every predetermined crank angle; and an intake pressure sensor 96 is installed at an appropriate location of the air intake pipe 54 of the engine 52 to produce an output or signal indicative of absolute pressure (negative pressure of engine) in the air intake pipe 54.

A trim angle sensor (trim angle detector; specifically rotation angle sensor such as rotary encoder) 98 is installed near the tilting shaft 16 to produce an output or signal corresponding to the trim angle of the outboard motor 12 (rotation angle of the outboard motor 12 about a pitch-axis relative to the hull 10).

The aforesaid sensors and the GPS receiver 30 are connected to the ECU 22 through a communication method standardized by the National Marine electronics Association (e.g. NMEA2000, i.e. the Controller Area Network).

The ECU 22 controls operation of the electric motors 44, 60 and 82 based on inputted sensor outputs and the like and conducts a shift control of the transmission 66 and a trim angle control for regulating the trim angle with the power tilt/trim unit 50. As mentioned above, the apparatus for controlling the outboard motor 12, according to this embodiment is constituted as a Drive-By-Wire fashion in which the mechanical connection between the operation system (including steering wheel 26 and shift/throttle lever 28) and the outboard motor 12 is cut out.

Figure 4:
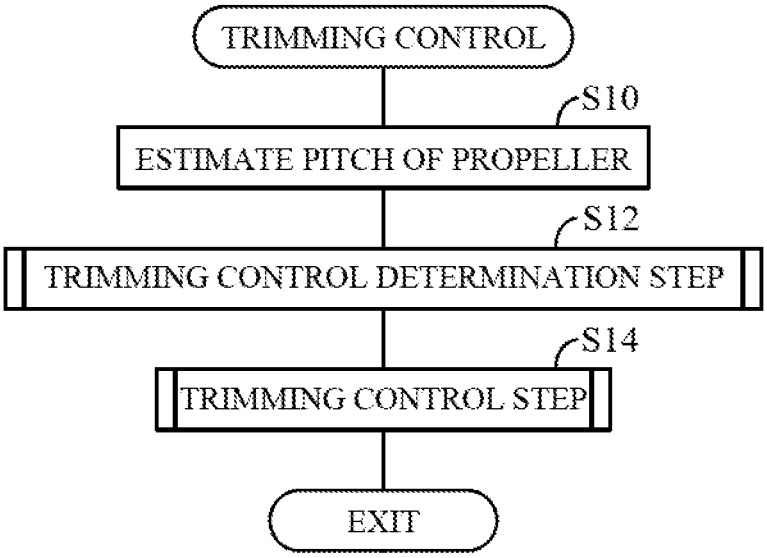
FIG. 4 is a flowchart showing a trim angle control operation of the apparatus conducted by an electronic Control Unit of the outboard motor shown in FIG. 1.

FIG. 4 is a flowchart showing the trim angle control operation of the ECU 22. The illustrated program is executed by the ECU 22 at a predetermined interval.

The program begins at S10, in which a pitch of the propeller is estimated. The pitch of the propeller is a value indicating a theoretical distance that the boat 1 advances during one revolution of the propeller 18.

The estimation of the pitch of the propeller is conducted at every engine starting, specifically the estimation is conducted based on the navigation speed, engine speed and gear reduction ratio (all are actual value) of the boat 1 at trolling of the boat 1, i.e. in low-speed and low-revolution condition after engine starting, and a predefined slip ratio of the propeller 18 at trolling of the boat 1 measured (set) by tests and the like in advance.

The pitch of the propeller is estimated based on an equation for calculating a slip ratio $\epsilon$ of the propeller 18 that indicates the rotating state of the propeller 18 and an equation for calculating a theoretical navigation speed Va of the boat 1.

The slip ratio $\epsilon$ of the propeller 18 is calculated based on the theoretical navigation speed Va and actual navigation speed V of the boat 1 using the following equation (1), and the theoretical navigation speed Va is calculated based on the operating condition of the engine 52 and the transmission 66 and the specifications of the propeller 18 using the following equation (2).

$$\text{Slip ratio } \epsilon = (\text{Theoretical navigation speed } Va \text{ (km/h)} - \text{Detected navigation speed } V \text{ (km/h)})/(\text{Theoretical navigation speed } Va \text{ (km/h)}) \quad (1)$$

$$\text{Theoretical navigation speed } Va \text{ (km/h)} = (\text{Engine speed } NE \text{ (rpm)} \times \text{Pitch of propeller (inches)} \times 60 \times 2.54 \times 10^{-5})/(\text{Gear reduction ratio}) \quad (2)$$

With these equations (1) and (2), the pitch of the propeller is calculated (estimated) using a following equation (3).

$$\text{Pitch of propeller} = (\text{Gear reduction ratio} \times \text{Detected navigation speed } V \text{ (km/h)})/(\text{Engine speed } NE \text{ (rpm)} \times 60 \times 2.54 \times 10^{-5} \times (1 - \text{Slip ratio } \epsilon) \quad (3)$$

In the equation (3), the slip ratio $\epsilon$ is the predefined slip ratio at trolling of the boat 1 that has been measured by tests and the like in advance, e.g. 65%. It has been confirmed by tests and the like that slip ratios at trolling of boats become almost the same value regardless of type and size etc. of the outboard motor 12. Therefore, this predefined slip ratio at trolling of the boat 1 can be applied to any outboard motor, and the pitch of the propeller can be estimated based on this predefined slip ratio whenever the boat 1 is trolling after engine starting. In other words, since the slip ratio at trolling of the boat 1 is already known, given the actual navigation speed V and the engine speed NE etc. at trolling of the boat 1, the pitch of the propeller can also be estimated based on the equation (3).

Specifically, for example, given the actual navigation speed V is 4 km/h, the engine speed NE is 650 rpm and the gear reduction ratio is 2.0 (predefined slip ratio is 65%) at trolling of the boat 1, the pitch of the propeller is estimated as 23 inches using the equation (3). As mentioned above, the estimation of the pitch of the propeller is conducted at every engine starting, specifically the pitch of the propeller is estimated based on the average value from the time when gears are engaged after engine starting to the time when the navigation speed V or engine speed NE of the boat 1 reaches to a predetermined value (e.g. 6 km/h or 800 rpm respectively). In other words, the estimation of the pitch of the propeller is completed when the navigation speed V or engine speed NE of the boat 1 exceeds the predetermined value (e.g. 6 km/h or 800 rpm respectively).

In the equation (1), the actual navigation speed V is detected or calculated from the outputs of the GPS receiver 30 (positional information). In the equation (2), the gear reduction ratio is the currently selected gear reduction ratio of the transmission 66; for example, the gear reduction ratio in the second speed is 1.9; the value 60 is a factor to be used to convert the engine speed NE from revolutions per minute to an hourly value; and the value $2.54 \times 10^{-5}$ is a factor to be used to convert the pitch of the propeller from inches to kilometers.

The program next proceeds to S12, in which a trimming control determination step that determines whether to conduct a trimming control, i.e. to trim up or trim down the outboard motor 12, is conducted.

Figure 5:
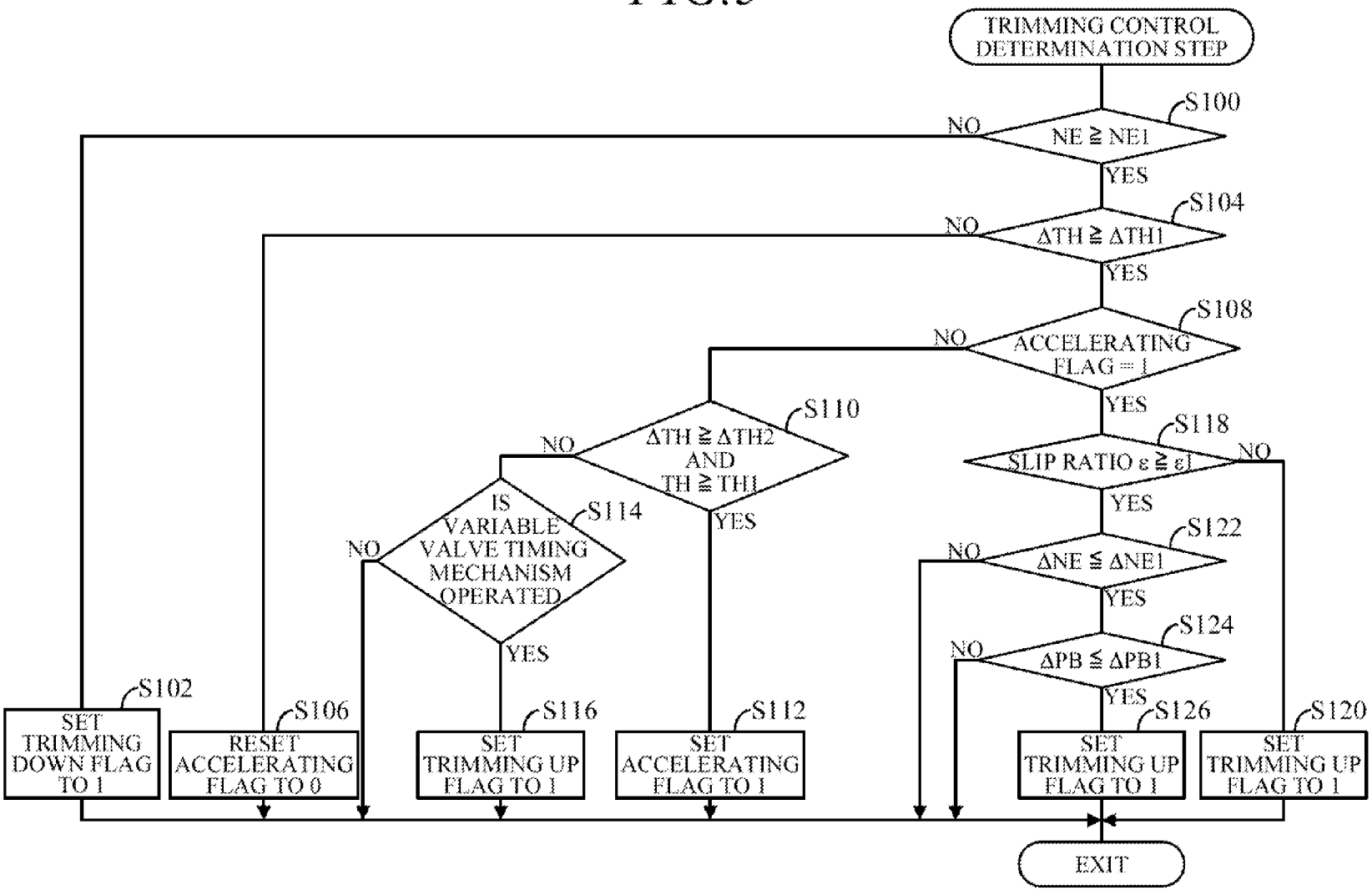
FIG. 5 is a flowchart showing the subroutine of a trimming control determination step shown in the flowchart in FIG. 4.

FIG. 5 is a flowchart showing the subroutine of the trimming control determination step. The program begins at S100, in which the engine speed NE is detected based on the outputs of the crank angle sensor 94 and it is determined whether the detected engine speed NE is equal to or greater than a predetermined first value NE1 (e.g. 2500 rpm).

When the result in S100 is negative, the program proceeds to S102, in which the bit of a trimming down flag is set to 1. The trimming down flag is to be set to 1 when trimming down is to be started and the processing from S100 to S102 is to start trimming down in low-revolution condition, i.e. when the engine speed NE is smaller than the predetermined first value NE1.

On the other hand, when the result in S100 is affirmative, the program proceeds to S104, in which a change amount ΔTH of the throttle opening TH per unit time is calculated based on the outputs of the throttle opening sensor 90 thereby determining whether the calculated change amount ΔTH is equal to or greater than a predetermined first value ΔTH1.

The processing in S104 is to determine whether the boat 1 is not in a decelerating state, and the predetermined first value ΔTH1 is set to a negative value (e.g. −2 degrees). Therefore, when the result in S104 is negative, specifically when the change amount ΔTH is smaller than the predetermined first value ΔTH1, the boat 1 is in the decelerating state and the program proceeds to S106, in which the bit of an accelerating flag that indicates that the boat 1 is in an accelerating state is reset to 0.

On the other hand, when the result in S104 is affirmative, the program proceeds to S108, in which it is determined whether the bit of the accelerating flag is 1, specifically whether the boat 1 is in the accelerating state. In the first program loop, the bit of the accelerating flag is naturally 0 and the result in S108 is naturally negative, and the program proceeds to S110, in which it is determined whether the change amount ΔTH is equal to or greater than a predetermined second value ΔTH2 and the throttle opening TH is equal to or greater than a predetermined first value TH1. Since the processing in S110 is to determine whether the boat 1 is in the accelerating state, the predetermined second throttle opening change amount ΔTH2 is set to 5 degrees/ms and the predetermined first throttle opening TH1 is set to 65 degrees, for example.

When the result in S110 is negative, specifically when the boat 1 is not in the accelerating state, the program proceeds to S114, in which it is determined whether the variable valve timing mechanism 62 is operated. When the variable valve timing mechanism 62 is operated, the drive signal is outputted from the ECU 22 to the variable valve timing mechanism 62. Therefore, it is possible to determine whether the variable valve timing mechanism 62 is operated based on the presence or absence of this drive signal.

When the result in S114 is negative, the program terminates the processing, but if the result in S114 is affirmative, specifically the variable valve timing mechanism 62 is operated when the boat 1 is not in the accelerating state (when the result in S110 is negative), the program proceeds to S116, in which the bit of a trimming up flag is set to 1. The trimming up flag is to be set to 1 when trimming up is to be started.

When the result in S110 is affirmative, specifically when the change amount ΔTH is equal to or greater than the predetermined second value ΔTH2 and the throttle opening TH is equal to or greater than the predetermined first value TH1, i.e. when the boat 1 is in the accelerating state, the program proceeds to S112, in which the accelerating flag that indicates that the boat 1 is in the accelerating state is set to 1.

When the result in S108 is affirmative, specifically when the bit of the accelerating flag is set to 1, in other words when the boat is in the accelerating state, the program proceeds to S118, in which the slip ratio ϵ (operating parameter) of the propeller 18 is calculated and it is determined whether the calculated slip ratio ϵ is equal to or greater than a predetermined first value ϵ1. The slip ratio ϵ is calculated based on the pitch of the propeller calculated (estimated) in the processing in S10 using the equation (1). The predetermined first value ϵ1 is set to a threshold value that enables to determine whether the grip force of the propeller 18 is weak, e.g. 0.5 (50%).

When the result in S118 is negative, specifically when the slip ratio ϵ is smaller than the predetermined first value ϵ1, in other words when the grip force of the propeller 18 is relatively large (slipperiness is small), the program proceeds to S120, in which the bit of the trimming up flag is set to 1. Specifically, the processing in S108, S118 and S120 is to start trimming up if the slip ratio ϵ is smaller than the predetermined first value ϵ1 when the boat 1 is in the accelerating state.

As mentioned above, since trimming up is started only if the slip ratio ϵ is smaller than the predetermined first value ϵ1 when the boat 1 is in the accelerating state, it becomes possible to suppress occurrence of cavitation.

On the other hand, when the result in S118 is affirmative, the program proceeds to S122, in which a change amount ΔNE (operating parameter) of the engine speed NE per unit time is calculated and it is determined whether the calculated change amount ΔNE is equal to or smaller than a predetermined first value ΔNE1 (e.g. 200 rpm/s).

When the result in S122 is negative, the program terminates the processing, but when the result in S122 is affirmative, the program proceeds to S124, in which a change amount ΔPB (operating parameter) of a detected intake pressure PB of the engine 52 per unit time is calculated based on the outputs of the intake pressure sensor 96 and it is determined whether the calculated change amount ΔPB is equal to or smaller than a predetermined first value ΔPB1 (e.g. 1 kPa/s).

When the result in S124 is negative, the program terminates the processing, but when the result in S124 is affirmative, the program proceeds to S126, in which the bit of the trimming up flag is set to 1. Specifically, the bit of the trimming up flag is set to 1 to start trimming up if the engine speed change amount ΔNE is equal to or smaller than the predetermined first value ΔNE1 (S122) and the intake pressure change amount ΔPB is equal to or smaller than the predetermined first value ΔPB1 when the boat 1 is in the accelerating state (S108) and the slip ratio ϵ of the propeller 18 is equal to or greater than the predetermined first value ϵ1 (S118).

Returning to the explanation of the flowchart in FIG. 4, the program next proceeds to S14, in which a trimming control step is conducted.

Figure 6:
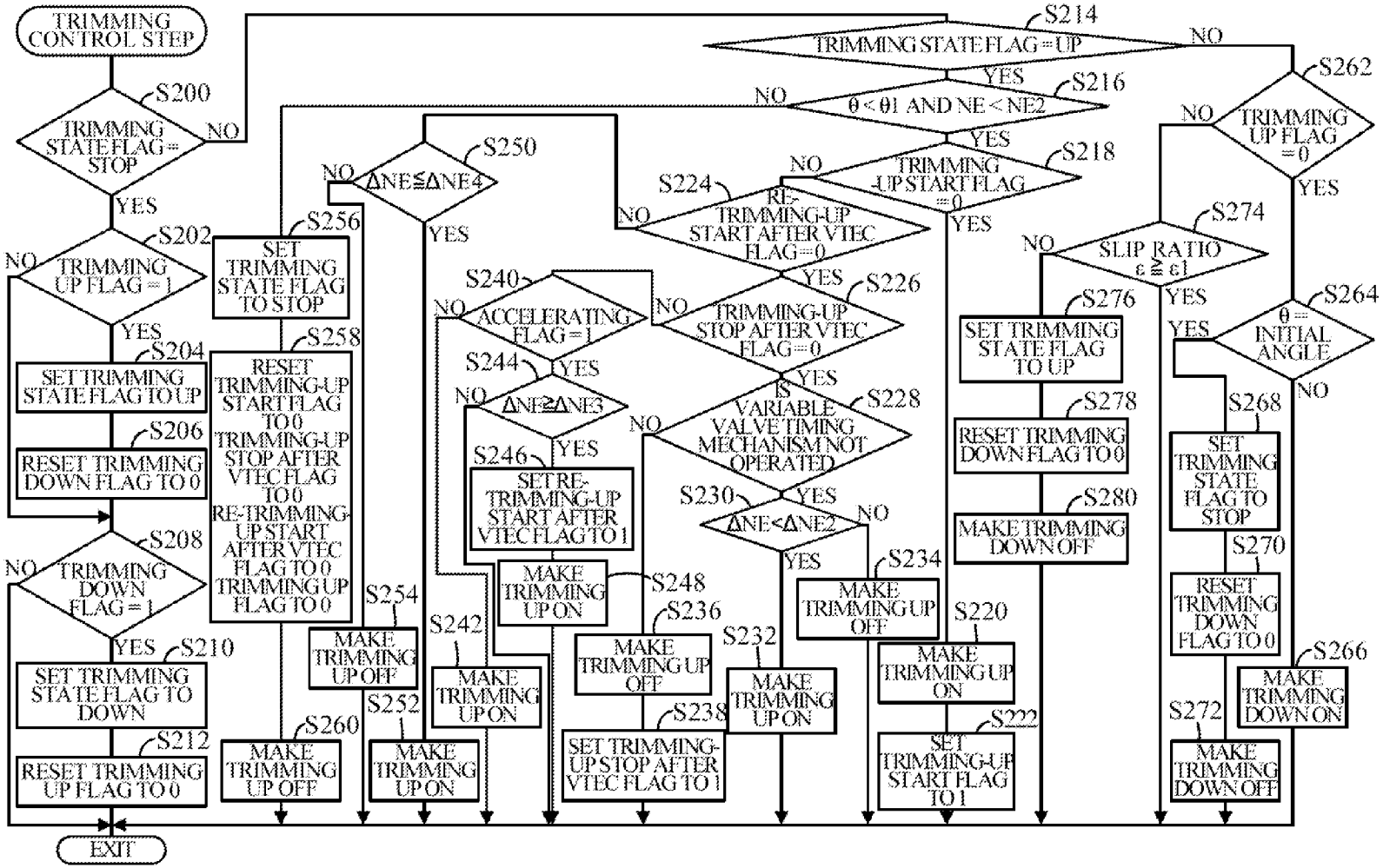
FIG. 6 is a flowchart showing the subroutine of a trimming control step shown in the flowchart in FIG. 4.

FIG. 6 is a flowchart showing the subroutine of the trimming control step. As shown in FIG. 6, the program begins at S200, in which it is determined whether a trimming state flag is STOP. The trimming state flag is to determine whether trimming is stopped, trimming up is conducted or trimming down is conducted, and to be inputted a value corresponding to STOP, UP or DOWN, respectively. In the first program loop, the trimming state flag is naturally STOP and the result in S200 is affirmative, and the program proceeds to S202, in which it is determined whether the bit of the trimming up flag is 1.

When the result in S202 is negative, the program skips the processing in S204 and S206 and proceeds to S208, but when the result in S202 is affirmative, the program proceeds to S204, in which the trimming state flag is set to UP, and to S206, in which the bit of the trimming down flag is reset to 0.

The program next proceeds to S208, in which it is determined whether the bit of the trimming down flag is 1. When the result in S208 is negative, the program skips the following processing and terminates the processing, but when the result in S208 is affirmative, the program proceeds to S210, in which the trimming state flag is set to DOWN, and to S212, in which the bit of the trimming up flag is reset to 0.

When the result in S200 is negative, specifically when the trimming state flag is not STOP, the program proceeds to S214, in which it is determined whether the trimming state flag is UP.

When the result in S214 is affirmative, the program proceeds to S216, in which it is determined whether the trim angle θ is smaller than a predetermined first value θ1 and the engine speed NE is smaller than a predetermined second value NE2. The predetermined trim angle θ1 is nearly equal to the maximum value of the trim angle θ and is set to 15 degrees, for example; while the predetermined second engine speed NE2 is nearly equal to the maximum engine speed NE of the engine 52 and is set to 6,000 rpm, for example.

In the first program loop, the result in S216 is naturally affirmative, and the program proceeds to S218, in which it is determined whether the bit of a trimming-up start flag is 0. The trimming-up start flag is to determine whether trimming up has been started; setting the bit of this flag to 1 means that trimming up has been started.

When the result in S218 is affirmative, specifically when the bit of the trimming-up start flag is 0 and trimming up has not been started, the program proceeds to S220, in which trimming up is started (shown as "TRIMMING UP ON"), and to S222, in which the bit of the trimming-up start flag is set to 1.

When the bit of the trimming-up start flag is set to 1, the result in S218 becomes negative and the program proceeds to S224, in which it is determined whether a re-trimming-up start after VTEC flag is 0. The re-trimming-up start after VTEC flag is to determine whether trimming up has been started again after the variable valve timing mechanism 62 was operated to stop trimming up; setting the bit of this flag to 1 means that trimming up has been started again after the variable valve timing mechanism 62 was operated.

When the result in S224 is affirmative, the program proceeds to S226, in which it is determined whether a trimming-up stop after VTEC flag is 0. The trimming-up stop after VTEC flag is to determine whether trimming up has been stopped after the variable valve timing mechanism 62 was operated; setting the bit of this flag 1 means that trimming up has been stopped after the variable valve timing mechanism 62 was operated.

When the result in S226 is affirmative, the program proceeds to S228, in which it is determined whether the variable valve timing mechanism 62 is not operated. When the result in S228 is affirmative, the program proceeds to S230, in which the engine speed change amount ΔNE is calculated and it is determined whether the calculated change amount ΔNE is smaller than a predetermined second value ΔNE2 (e.g. 500 rpm/s). When the result in S230 is affirmative, the program proceeds to S232, in which trimming up is started, but when the result in S230 is negative, the program proceeds to S234, in which trimming up is stopped (shown as "TRIMMING UP OFF").

Specifically, the processing in S218, S228 to S234 is to continue trimming up if the engine speed change amount ΔNE is smaller than the predetermined second value ΔNE2 (S230, S232), while to stop trimming up if the engine speed change amount ΔNE is equal to or greater than the predetermined second value ΔNE2 (S230, S234), when the variable valve timing mechanism 62 is not operated (S228) after trimming up has been started (S218). With these processing, it becomes possible to suppress occurrence of cavitation that can be caused when the engine speed change amount ΔNE becomes equal to or greater than the predetermined second value ΔNE2 during trimming up.

When the result in S228 is negative, specifically when the variable valve timing mechanism 62 is operated, the program proceeds to S236, in which trimming up is stopped, and to S238, in which the bit of the trimming-up stop after VTEC flag is set to 1. When the variable valve timing mechanism 62 is operated during trimming up, cavitation can be caused around the propeller 18 by abruptly increasing the power of the engine, but occurrence of such cavitation can be suppressed by stopping trimming up when the variable valve timing mechanism 62 is operated during trimming up.

When the bit of the trimming-up stop after VTEC flag is set to 1, the result in S226 becomes negative and the program proceeds to S240, in which it is determined whether the bit of the accelerating flag is 1. When the result in S240 is negative, specifically when the boat 1 is not in the accelerating state, the program proceeds to S242, in which trimming up is started; but when the result in S240 is affirmative, specifically when the boat 1 is in the accelerating state, the program proceeds to S244, in which it is determined whether the engine speed change amount ΔNE is equal to or greater than a predetermined third value ΔNE3 (e.g. 300 rpm/s).

When the result in S244 is negative, the program terminates the processing; but when the result in S244 is affirmative, the program proceeds to S246, in which the bit of the re-trimming-up start after VTEC flag is set to 1, and to S248, in which trimming up is started.

Specifically, the processing in S226, S240 to S248 is to start trimming up again if the boat 1 is not in the accelerating state or if the engine speed change amount ΔNE is equal to or greater than the predetermined third value ΔNE3, when the boat 1 is in the accelerating state (S240 to S248), after the variable valve timing mechanism 62 was operated and trimming up has been stopped (S228, S236, S238, S226).

When the bit of the re-trimming-up start after VTEC flag is set to 1 in S246, the result in S224 becomes negative and the program proceeds to S250, in which it is determined whether the engine speed change amount ΔNE is equal to or smaller than a predetermined fourth value ΔNE4 (e.g. 500 rpm/s). When the result in S250 is affirmative, the program proceeds to S252, in which trimming up is started; but when the result in S250 is negative, the program proceeds to S254, in which trimming up is stopped.

When the result in S216 is negative, specifically when the trim angle θ is equal to or greater than the predetermined first value θ1 or the engine speed NE is equal to or greater the than predetermined second engine speed NE2, the program proceeds to S256, in which the trimming state flag is set to STOP. Specifically, the processing in S216 is to stop trimming up when the trim angle reaches the maximum value (e.g. 15 degrees) or the engine speed NE reaches the value representing high-revolution condition (e.g. 6000 rpm) after trimming up has been started.

The program next proceeds to S258, in which all of the bits of the trimming-up start flag, trimming-up stop after VTEC flag, re-trimming-up start after VTEC flag and trimming up flag are reset to 0, and to S260, in which trimming up is stopped.

When the result in S214 is negative, specifically when the trimming state flag is not set to STOP nor UP, in other words when the trimming state flag is set to DOWN, the program proceeds to S262, in which it is determined whether the bit of the trimming up flag is 0. When the trimming state flag is set to DOWN, since the bti of the trimming up flag is naturally 0 (S210, S212), the result in S262 is naturally affirmative and the program proceeds to S264, in which it is determined whether the trim angle θ is the initial angle (e.g. 0 degree).

When the result in S264 is negative, the program proceeds to S266, in which trimming down is continued (shown as "TRIMMING DOWN ON"); but when the result in S264 is affirmative, the program proceeds to S268, in which the trimming state flag is set to STOP, and to S270, in which the bit of the trimming down flag is reset to 0, and to S272, in which trimming down is stopped (shown as "TRIMMING DOWN OFF").

When the result in S262 is negative, specifically when the bit of the trimming up flag is 1, the program proceeds to S274, in which the slip ratio ϵ is calculated and it is determined whether the calculated slip ratio ϵ is equal to or greater than the predetermined first value ϵ1.

When the result in S274 is affirmative, the program terminates the processing; but when the result in S274 is negative, the program proceeds to S276, in which the trimming state flag is set to UP, and to S278, in which the bti of the trimming down flag is rest to 0, and to S280, in which trimming down is stopped.

Figure 7:
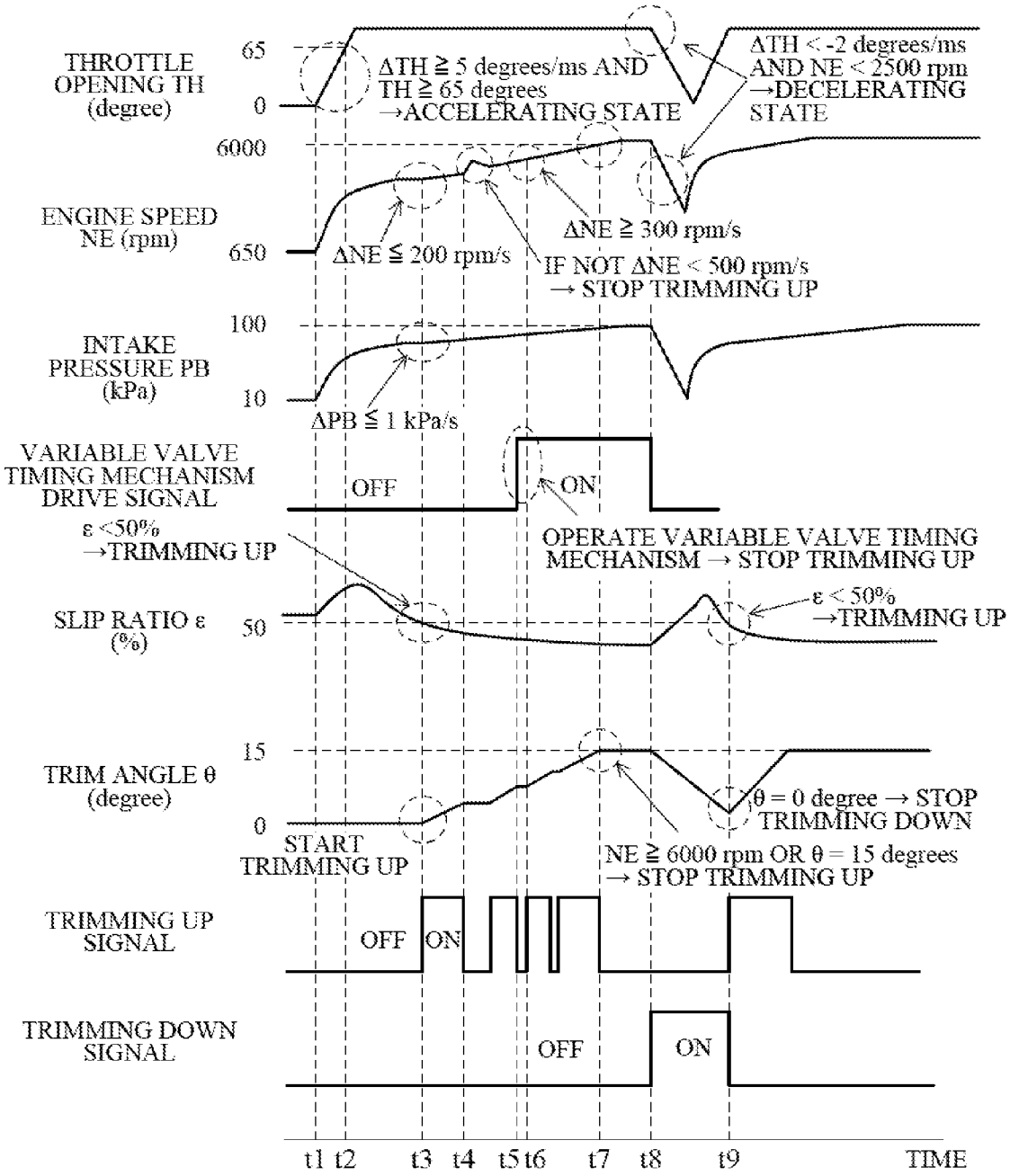
FIG. 7 is a time chart showing the control mentioned in the flowcharts in FIGS. 4 to 6.
Figure 8:
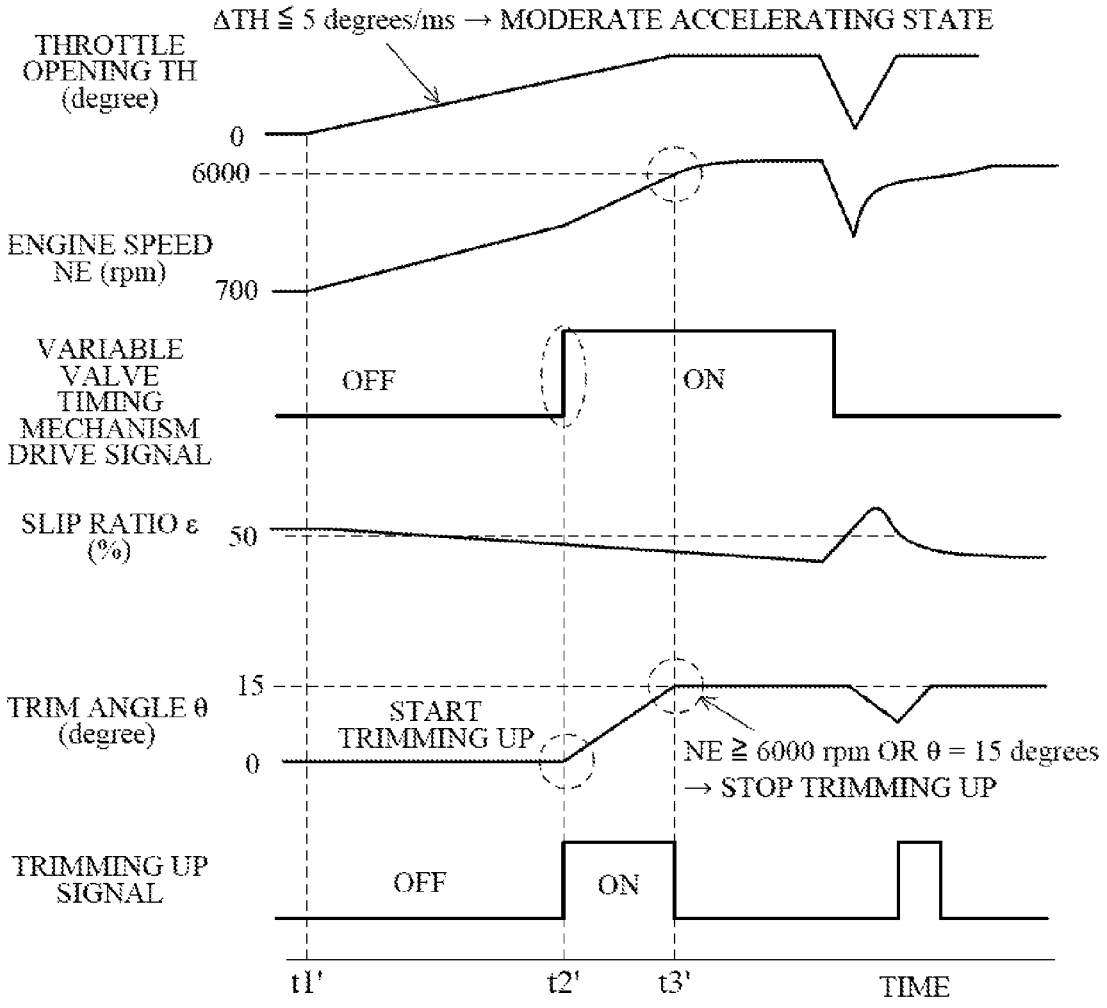
FIG. 8 is a time chart showing the remaining control mentioned in the flowcharts in FIGS. 4 to 6.

FIGS. 7, 8 are time charts partially showing the control mentioned above.

First, the processing in the case that the boat 1 is in the accelerating state, more specifically in a sudden accelerating state, will be explained based on FIG. 7. From t1 to t2, since the throttle opening change amount ΔTH is equal to or greater than the predetermined second value ΔTH2 (e.g. 5 degrees/ms) and the throttle opening TH becomes equal to or greater than the predetermined first value TH1 (e.g. 65 degrees), it is determined that the boat 1 is in the accelerating state (S110, S112).

Then, at t3, since the engine speed change amount ΔNE is equal to or smaller than the predetermined first value ΔNE1 (e.g. 200 rpm/s) and the intake pressure change amount ΔPB is equal to or smaller than the predetermined first value ΔPB1 (e.g. 1 kPa/s), trimming up is started (S122, S124, S126). Also, since the slip ratio ϵ becomes smaller than the predetermined first value ϵ1 (e.g. 0.5), trimming up is started (S118, S120).

In this example, all of the conditions for trimming up: the engine speed change amount ΔNE is equal to or smaller than the predetermined first value ΔNE1; the intake pressure change amount ΔPB is equal to or smaller than the predetermined first value ΔPB1; and the slip ratio ϵ is smaller than the predetermined first value ϵ1, are met at t3. However, it is merely an example for explanation and it is not necessary to meet all of these three conditions for starting trimming up. In other words, trimming up is started if the engine speed change amount ΔNE is equal to or smaller than the predetermined first value ΔNE1 and the intake pressure change amount ΔPB is equal to or smaller than the predetermined first value ΔPB1 when the slip ratio ϵ is equal to or greater than the predetermined first value ϵ1; and trimming up is started regardless of the values of the engine speed change amount ΔNE and the intake pressure change amount ΔPB when the slip ratio c is smaller than the predetermined first value ϵ1.

Then, at t4, since the engine speed change amount ΔNE becomes equal to or greater than the predetermined second value ΔNE2 (e.g. 500 rpm/s), trimming up is stopped (S230, S234). As shown, at t5, since it is determined that the variable valve timing mechanism 62 is operated, trimming up is stopped (S228, S236).

Then, at t6, since the engine speed change amount ΔNE becomes equal to or greater than the predetermined third value ΔNE3 (e.g. 300 rpm/s), trimming up is started again (S244, S248).

As shown, at t7, since the engine speed NE becomes equal to or greater than the predetermined second value NE2 (e.g. 6000 rpm) or the trim angle θ becomes equal to or greater than the predetermined first θ1 (e.g. 15 degrees), trimming up is stopped (S216, S260).

Then, at t8, since acceleration has been completed and the boat 1 comes into the decelerating state (the throttle opening change amount ΔTH becomes smaller than the predetermined first value ΔTH1 (e.g. −2 degrees/ms) and the engine speed NE becomes smaller than the predetermined first value NE1 (e.g. 2500 rpm)), trimming down is started (S100, S102, S104, S266). Then, at t9, since the trim angle θ becomes equal to the initial angle (e.g. 0 degree), trimming down is stopped (S264, S272); and since the slip ratio ϵ becomes equal to or smaller than a predetermined slip ratio ϵ1, trimming up is started (S274, S280).

Next, the processing in the case that the boat 1 is in a moderate accelerating state will be explained based on FIG. 8. First, after t1', since the throttle opening change amount ΔTH is equal to or smaller than the predetermined value (e.g. 5 degrees/ms), it is determined that the boat 1 is in the moderate accelerating state. Then, at t2', since it is determined that the variable valve timing mechanism 62 is operated, trimming up is started (S114, S116).

Then, at t3', since the engine speed NE becomes equal to or greater than the predetermined second value NE2 or the trim angle θ becomes equal to or greater than the predetermined value θ1, trimming up is stopped (S216, S260).

As stated above, the embodiment of this invention is configured to have an apparatus and method for controlling an outboard motor (12) configured to be mounted on a hull (10) of a boat (1) and equipped with an internal combustion engine (engine 52) to power a propeller (18) and a trim angle regulating mechanism (power tilt/trim unit 50) configured to regulate a trim angle (θ) relative to the hull, comprising: a throttle opening sensor (90) configured to produce an output indicative of a throttle opening of the engine; and an electronic control unit (ECU 22) configured to calculate a throttle opening change amount (ΔTH; change amount of a throttle opening TH) of the engine based on the output (S12, S110), determine whether the boat is in an accelerating state based on the calculated throttle opening change amount (S12, S110), and control operation of the trim angle regulating mechanism to increase the trim angle based on an operating parameter that indicates a state of the engine and the propeller when determining that the boat is in the accelerating state (S12, S108, S118, S120, S122, S124, S126).

Specifically, it is configured to start trimming up based on the operating parameters of the boat 1, for example, the slip ratio ϵ of the propeller 18, the engine speed change amount ΔNE and the like. With this, it becomes possible to suppress occurrence of cavitation whenever possible even conducting trimming up during acceleration of the boat 1.

In the apparatus and method, the operating parameter is at least one of a slip ratio (ϵ) of the propeller calculated based on a theoretical navigation speed (Va) and a detected navigation speed (V) of the boat, an engine speed change amount (ΔNE; change amount of an engine speed NE) and an intake pressure change amount (ΔPB; change amount of an intake pressure PB) of the engine (S12, S118, S122, S124). With this, it becomes possible to suppress occurrence of cavitation whenever possible even conducting trimming up during acceleration of the boat 1.

In the apparatus and method, the electronic control unit controls operation of the trim angle regulating mechanism to increase the trim angle if the slip ratio of the propeller becomes smaller than a predetermined slip ratio (ϵ1) when determining that the boat is in the accelerating state (S12, S118, S120). With this, it becomes possible to further suppress occurrence of cavitation even conducting trimming up during acceleration of the boat 1.

In the apparatus and method, the electronic control unit estimates a pitch of the propeller based on a predefined slip ratio at trolling of the boat (S10. equation (3)), calculates the theoretical navigation speed of the boat based on the estimated pitch of the propeller (equation (2)), and calculates the slip ratio of the propeller based on the calculated theoretical navigation speed and the detected navigation speed of the boat (S10, S12, S14, S118, S274. equation (1)). With this, it becomes possible to eliminate the need to set the pitch of the propeller for each outboard motor 12 to add the control that is based on the slip ratio ϵ even when, for example, the outboard motor 12 installed on the boat 1 is already in the market and the like. Specifically, the values of the pitch of the propeller, which will be needed in the calculation of the slip ratio ϵ, should have been known and set for each outboard motor 12 before shipment, because they are differ between outboard motors 12 (boats 1) concerned and it is difficult to add the control that is based on the slip ratio even when, for example, the outboard motor 12 installed on the boat 1 is already in the market and the like; however, if the pitch of the propeller can be estimated, it becomes possible to eliminate the need to set the pitch of the propeller for each outboard motor 12 to add the control that is based on the slip ratio ϵ even when, for example, the outboard motor 12 installed on the boat 1 is already in the market and the like.

In the apparatus and method, the electronic control unit controls operation of the trim angle regulating mechanism to increase the trim angle if the engine speed change amount becomes equal to or smaller than a predetermined engine speed change amount (predetermined first value ΔNE1) when determining that the boat is in the accelerating state (S12, S108, S122, S126). With this, it becomes possible to further suppress occurrence of cavitation even conducting trimming up during acceleration of the boat 1.

In the apparatus and method, the electronic control unit controls operation of the trim angle regulating mechanism to increase the trim angle if the intake pressure change amount becomes equal to or smaller than a predetermined intake pressure change amount (ΔPB1) when determining that the boat is in the accelerating state (S12, S108, S124, S126). With this, it becomes possible to further suppress occurrence of cavitation even conducting trimming up during acceleration of the boat 1.

In the apparatus and method, the electronic control unit controls operation of the trim angle regulating mechanism to stop increasing the trim angle when the engine speed change amount becomes equal to or greater than a predetermined second engine speed change amount (ΔNE2) after starting to increase the trim angle (S14, S230, S234). With this, it becomes possible to suppress occurrence of cavitation by stopping increasing the trim angle θ when engine speed change amount ΔNE becomes equal to or greater than the predetermined second value ΔNE2 during acceleration of the boat 1.

In the apparatus and method, the engine has a variable valve timing mechanism (62) that changes a valve timing of at least one of an intake valve and an exhaust valve based on the operating condition of the engine, and the electronic control unit determines whether the variable valve timing mechanism changes the valve timing and controls operation of the trim angle regulating mechanism to stop increasing the trim angle when determining that the variable valve timing mechanism changes the valve timing after starting to increase the trim angle (S14, S228, S236). With this, it becomes possible to further suppress occurrence of cavitation by stopping increasing the trim angle θ when determining that the variable valve timing mechanism 62 changes the valve timing during acceleration of the boat 1.

In the apparatus and method, the electronic control unit controls operation of the trim angle regulating mechanism to increase the trim angle when the engine speed change amount becomes equal to or greater than a predetermined third engine speed change amount (ΔNE3) after determining that the variable valve timing mechanism changes the valve timing to stop increasing the trim angle (S14, S240, S244, S248). With this, it becomes possible to accelerate smoothly without causing cavitation by increasing the trim angle θ when the engine speed change amount ΔNE becomes equal to or greater than the predetermined third value ΔNE3, even if determining that the variable valve timing mechanism 62 changes the valve timing and increasing of the trim angle θ is stopped during acceleration.

In the apparatus and method, the electronic control unit controls operation of the trim angle regulating mechanism to increase the trim angle when determining that the boat is in a state other than the accelerating state and determining that the variable valve timing mechanism changes the valve timing (S12, S110, S114, S116). With this, it becomes possible to accelerate smoothly by starting trimming up when the boat 1 is not in the accelerating state, or in the moderate accelerating state, even if determining that the variable valve timing mechanism 62 changes the valve timing.

In the apparatus and method, the electronic control unit controls operation of the trim angle regulating mechanism to stop increasing the trim angle when an engine speed of the engine becomes equal to or greater than the predetermined engine speed (predetermined second engine speed NE2, e.g. 6000 rpm) after determining that the variable valve timing mechanism 62 changes the valve timing to start increasing the trim angle (S14, S216, S260). With this, it becomes possible to suppress occurrence of cavitation by stopping increasing the trim angle θ when the engine speed NE becomes equal to or greater than the predetermined engine speed NE2, even if determining that the variable valve timing mechanism 62 changes the valve timing and increasing of the trim angle θ is started.

The apparatus and method further including: a trim angle detector (trim angle sensor 98) that detects the trim angle (θ) of the outboard motor relative to the hull (S14, S216); and the electronic control unit controls operation of the trim angle regulating mechanism to stop increasing the trim angle when the detected trim angle becomes equal to or greater than a predetermined angle (θ1) after determining that the variable valve timing mechanism changes the valve timing to start increasing the trim angle (S14, S216, S260). With this, it becomes possible to stop increasing the trim angle θ completely when the trim angle θ reaches, for example, the maximum angle (e.g. 15 degrees).

In the apparatus and method, the electronic control unit determines whether the boat is in a decelerating state based on the calculated throttle opening change amount and the engine speed (S12, S100, S104), and controls operation of the trim angle regulating mechanism to decrease the trim angle when determining that the boat is in the decelerating state (S12, S102). With this, it becomes possible to optimally control the trim angle θ accordingly when the boat 1 is in the decelerating state.

It should be noted that, although the invention has been mentioned for the outboard motor 12 exemplified above, the invention can be applied to an inboard motor.

It should further be noted that, although the intake pressure change amount ΔPB is used in S124 in the flowchart in FIG. 5 or at t3 in the time chart in FIG. 7, the intake pressure PB itself can instead be used. Specifically, trimming up can be started when the intake pressure PB becomes equal to or smaller than a predetermined value (e.g. 80 kPa).

It should further be noted that, although the predetermined first engine speed NE1, predetermined second engine speed NE2, predetermined first to fourth engine speed change amount ΔNE1 to ΔNE4, predetermined first, second throttle opening change amount ΔTH1, ΔTH2, predetermined first throttle opening TH1, predetermined first intake pressure change amount ΔPB1, predetermined first slip ratio ϵ1, predetermined first angle θ1 etc. are mentioned above as the specific values, they are merely examples and should not be limited thereto.

Japanese Patent Application Nos. 2013-72843 and 2013-73445, both filed on Mar. 29, 2013, are incorporated by reference herein in its entirety.

While the invention has thus been shown and described with reference to a specific embodiment, it should be noted that the invention is in no way limited to the details of the described arrangement; changes and modifications may be made without departing from the scope of the appended claims.

What is claimed is:

1. A method for controlling an outboard motor configured to be mounted on a hull of a boat and equipped with an internal combustion engine to power a propeller and a trim angle regulating mechanism configured to regulate a trim angle relative to the hull, comprising the steps of:

producing an output indicative of a throttle opening of the engine;

calculating a throttle opening change amount of the engine based on the output produced in the step of producing;

determining whether the boat is in an accelerating state based on the throttle opening change amount calculated in the step of calculating the throttle opening change amount;

determining whether a slip ratio of the propeller is smaller than a predetermined slip ratio, when the boat is determined to be in the accelerating state in the step of determining whether the boat is in the accelerating state;

determining whether an engine speed change amount of the engine is equal to or smaller than a predetermined engine speed change amount, when the slip ratio is determined to be equal to or greater than the predetermined slip ratio in the step of determining whether the slip ratio is smaller than the predetermined slip ratio;

determining whether an intake pressure change amount of the engine is equal to or smaller than a predetermined intake pressure change amount, when the engine speed change amount is determined to be equal to or smaller than the predetermined engine speed change amount in the step of determining whether the engine speed change amount is equal to or smaller than the predetermined engine speed change amount; and controlling operation of the trim angle regulating mechanism to increase the trim angle based on an operating parameter that indicates a state of the engine and the propeller, when the boat is determined to be in the accelerating state in the step of determining whether the boat is in the accelerating state and the slip ratio is determined to be smaller than the predetermined slip ratio in the step of determining whether the slip ratio is smaller than the predetermined slip ratio, or when the boat is determined to be in the accelerating state in the step of determining whether the boat is in the accelerating state, the slip ratio is determined to be equal to or greater than the predetermined slip ratio in the step of determining whether the slip ratio is smaller than the predetermined slip ratio, the engine speed change amount is determined to be equal to or smaller than the predetermined engine speed change amount in the step of determining whether the engine speed change amount is equal to or smaller than the predetermined engine speed change amount and the intake pressure change amount is determined to be equal to or smaller than the predetermined intake pressure change amount in the step of determining whether the intake pressure change amount is equal to or smaller than the predetermined intake pressure change amount, wherein the predetermined engine speed change amount is a predetermined first engine speed change amount, and the step of controlling operation of the trim angle regulating mechanism includes controlling operation of the trim angle regulating mechanism to stop increasing the trim angle when the engine speed change amount becomes equal to or greater than a predetermined second engine speed change amount after starting to increase the trim angle.

2. The method according to claim 1, wherein the step of controlling operation of the trim angle regulating mechanism includes calculating the slip ratio based on a theoretical navigation speed and a detected navigation speed of the boat.

3. The method according to claim 2, further including the steps of:

estimating a pitch of the propeller based on a predefined slip ratio at trolling of the boat; and calculating the theoretical navigation speed of the boat based on the pitch estimated in the step of estimating.

4. The method according to claim 2, further including the step of receiving a GPS signal, wherein the step of trim angle controlling includes the step of calculating the detected navigation speed of the boat based on the GPS signal received in the step of receiving.

5. The method according to claim 1, wherein the engine has a variable valve timing mechanism that changes a valve timing of at least one of an intake valve and an exhaust valve based on an operating condition of the engine, and the step of controlling operation of the trim angle regulating mechanism includes the step of determining whether the variable valve timing mechanism changes the valve timing, and includes controlling operation of the trim angle regulating mechanism to stop increasing the trim angle when the variable valve time mechanism is determined to change the valve timing in the step of determining whether the variable valve timing mechanism changes the valve timing after starting to increase the trim angle.

6. The method according to claim 5, wherein the predetermined engine speed change amount is a predetermined first engine speed change amount, and the step of controlling operation of the trim angle regulating mechanism includes controlling operation of the trim angle regulating mechanism to restart increasing the trim angle when the engine speed change amount becomes equal to or greater than a predetermined third engine speed change amount greater than the predetermined first engine speed change amount after the variable valve timing mechanism is determined to change the valve timing in the step of determining whether the variable valve timing mechanism changes the valve timing to stop increasing the trim angle.

7. The method according to claim 5, wherein the step of controlling operation of the trim angle regulating mechanism includes controlling operation of the trim angle regulating mechanism to stop increasing the trim angle when the engine speed change amount becomes greater than a predetermined fourth engine speed change amount greater than the predetermined third engine speed change amount after the variable valve timing mechanism is determined to change the valve timing in the step of determining whether the variable valve timing mechanism changes the valve timing to restart increasing the trim angle after stopping increasing the trim angle.

8. The method according to claim 5, wherein the step of controlling operation of the trim angle regulating mechanism includes controlling operation of the trim angle regulating mechanism to restart increasing the trim angle when the boat is determined to be in a state other than the accelerating state in the step of determining whether the boat is in the accelerating state after the variable valve timing mechanism is determined to change the valve timing in the step of determining whether the variable valve timing mechanism changes the valve timing to stop increasing the trim angle.

9. The method according to claim 1, wherein the engine has a variable valve timing mechanism that changes a valve timing of at least one of an intake valve and an exhaust valve based on the operating condition of the engine, and the step of controlling operation of the trim angle regulating mechanism includes the step of determining whether the variable valve timing mechanism changes the valve timing, and includes controlling operation of the trim angle regulating mechanism to increase the trim angle if the variable valve timing mechanism is determined to change the valve timing in the step of determining whether the variable valve timing mechanism changes the valve timing when the boat is determined to be in a state other than the accelerating state in the step of determining whether the boat is in the acceleration state.

10. The method according to claim 9, wherein the step of controlling operation of the trim angle regulating mechanism includes controlling operation of the trim angle regulating mechanism to stop increasing the trim angle when an engine speed of the engine becomes maximum engine speed after the variable valve timing mechanism is determined to change the valve timing in the step of determining whether the variable valve timing mechanism changes the valve timing to start increasing the trim angle.

11. The method according to claim 9, further including the step of detecting the trim angle of the outboard motor relative to the hull, and the step of controlling operation of the trim angle regulating mechanism includes controlling operation of the trim angle regulating mechanism to stop increasing the trim angle when the trim angle detected in the step of detecting the trim angle becomes a maximum angle after the variable valve timing mechanism is determined to change the valve timing in the step of determining whether the variable valve timing mechanism changes the valve timing to start increasing the trim angle.

12. The method according to claim 1, further including the step of determining whether the boat is in a decelerating state based on the throttle opening change amount calculated in the step of calculating the throttle opening change amount and an engine speed of the engine, and the step of controlling operation of the trim angle regulating mechanism includes controlling operation of the trim angle regulating mechanism to decrease the trim angle when the boat is determined to be in the decelerating state in the step of determining whether the boat is in the decelerating state.

* * * * *